US011426837B2

(12) United States Patent
Wallendorf et al.

(10) Patent No.: US 11,426,837 B2
(45) Date of Patent: Aug. 30, 2022

(54) TOOL SPINDLE FOR A DEVICE FOR FINE MACHINING OF OPTICALLY ACTIVE SURFACES ON WORKPIECES

(71) Applicant: Satisloh AG, Baar (CH)

(72) Inventors: Steffen Wallendorf, Wetzlar-Dutenhofen (DE); Holger Schäfer, Weilmünster (DE); Michael Leitz, Wetzlar (DE)

(73) Assignee: Satisloh AG.

( * ) Notice: Subject to any disclaimer, the term of this patent is extended or adjusted under 35 U.S.C. 154(b) by 934 days.

(21) Appl. No.: 16/093,425

(22) PCT Filed: Apr. 11, 2017

(86) PCT No.: PCT/EP2017/000470
§ 371 (c)(1),
(2) Date: Oct. 12, 2018

(87) PCT Pub. No.: WO2017/178110
PCT Pub. Date: Oct. 19, 2017

(65) Prior Publication Data

US 2019/0126432 A1 May 2, 2019

(30) Foreign Application Priority Data

Apr. 13, 2016 (CZ) ..... 102016004328.8

(51) Int. Cl.
*B24B 41/053* (2006.01)
*B24B 13/00* (2006.01)

(52) U.S. Cl.
CPC ..... *B24B 41/053* (2013.01); *B24B 13/00* (2013.01)

(58) Field of Classification Search
CPC ..... B24B 41/053; B24B 41/047; B24B 41/04; B24B 45/00; B24B 13/00; B24B 13/005; B24B 13/02; B24B 9/146; B23B 5/04
(Continued)

(56) References Cited

U.S. PATENT DOCUMENTS 1,748,174 A * 2/1930 Hirvonen ..... F16C 19/50 384/461
4,885,873 A 12/1989 Miyazaki
(Continued)

FOREIGN PATENT DOCUMENTS

CN 101041230 A 9/2007
CN 101356575 A 1/2009
(Continued)

OTHER PUBLICATIONS

Chinese Office Action for Chinese Application No. 201780029880.7 dated Apr. 9, 2020 (11 pages).
(Continued)

*Primary Examiner* — Tyrone V Hall, Jr.
*Assistant Examiner* — Makena S Markman
(74) *Attorney, Agent, or Firm* — Reising Ethington P.C.

(57) ABSTRACT

The invention relates to a tool spindle for a device for fine machining optically active surfaces on workpieces, having a spindle housing and a tool holding portion which protrudes beyond the housing. The tool holding portion can be axially advanced towards the workpiece along a tool rotational axis via a guiding assembly, which can be rotated about the tool rotational axis in the spindle housing. In order to axially advance the tool holding portion, the guide assembly has a plurality of linear mounting elements, which are distributed about the tool rotational axis in a uniform manner, and respective paired guide rods, which are connected to the tool holding portion in a traction- and pressure-resistant manner.

19 Claims, 4 Drawing Sheets

(58) Field of Classification Search
USPC ..... 451/363
See application file for complete search history.

(56) References Cited

U.S. PATENT DOCUMENTS

| | | | | |
|---|---|---|---|---|
| 5,740,699 | A | 4/1998 | Ballantyne et al. | |
| 5,980,360 | A * | 11/1999 | Murray | B23Q 1/5462 451/42 |
| 6,641,466 | B2 * | 11/2003 | Wallendorf | B24B 9/146 451/255 |
| 7,278,908 | B2 * | 10/2007 | Urban | B24B 13/012 451/259 |
| 7,559,829 | B2 | 7/2009 | Stephane et al. | |
| 7,588,480 | B2 | 9/2009 | Kuebler | |
| 8,210,903 | B2 | 7/2012 | Ueda | |
| 8,246,424 | B2 | 8/2012 | Philipps et al. | |
| 8,696,410 | B2 * | 4/2014 | Schussler | B24B 13/00 451/160 |
| 9,089,948 | B2 | 7/2015 | Schäfer et al. | |
| 9,289,877 | B2 | 3/2016 | Schafer et al. | |
| 9,579,770 | B2 * | 2/2017 | Pierednik | B24B 41/04 |
| 2013/0344778 | A1 * | 12/2013 | Schafer | B24B 41/04 451/294 |
| 2015/0337823 | A1 | 11/2015 | Moler et al. | |
| 2017/0246720 | A1 | 8/2017 | Wallendorf et al. | |
| 2017/0246729 | A1 | 8/2017 | Philipps et al. | |

FOREIGN PATENT DOCUMENTS

| | | | | |
|---|---|---|---|---|
| CN | 201720752 | U | 1/2011 | |
| DE | 29521396 | U1 | 2/1997 | |
| EP | 1099513 | A1 | 5/2001 | |
| GB | 295718 | A * | 8/1929 | B24B 13/02 |
| JP | S59169756 | A | 9/1984 | |
| WO | WO8504828 | A1 | 11/1985 | |

OTHER PUBLICATIONS

German Office Action; Applicant: Satisloh AG; Application No. 102016004328.8; dated Feb. 21, 2017; 5 pages.
International Search Report; Applicant: Satisloh AG; Application No. PCT/EP2017/000470; Filing Date Apr. 11, 2017; dated Aug. 22, 2017; 13 Pages.

* cited by examiner

TOOL SPINDLE FOR A DEVICE FOR FINE MACHINING OF OPTICALLY ACTIVE SURFACES ON WORKPIECES

TECHNICAL FIELD

The present invention relates generally to a tool spindle for a device for fine processing of optically effective surfaces of workpieces. In particular, the invention relates to a tool spindle for a device for fine processing of optically effective surfaces of spectacle lenses such as are widely used in so-called "RX workshops", i.e. fabrication facilities for producing individual spectacle lenses to prescription. However, this is not in any way to be understood as limiting; rather, use in precision optics is also contemplated (lens production, mirror production and casting-mold production), where a growing trend towards more complex components, in particular with aspherical surfaces and free-shape surfaces, can be observed.

Insofar as mention is made in the following by way of example to "spectacle lenses" for workpieces with optically effective surfaces there is to be understood by that not only spectacle lenses of mineral glass, but also spectacle lenses of all other customary materials such as polycarbonate, CR 39, HI index, etc., thus also plastics materials.

STATE OF THE ART

The processing of optically effective surfaces of spectacle lenses by material removal can be roughly divided into two processing phases, in particular initial preliminary processing of the optically effective surface so as to produce the macrogeometry (or topography) in accordance with the prescription and then fine processing of the optically effective surface in order to eliminate the tracks of preliminary processing and achieve the desired microgeometry. Whereas preliminary processing of optically effective surfaces of spectacle lenses is carried out by grinding, milling and/or turning depending on, inter alia, the material of the spectacle lenses, the optically effective surfaces of spectacle lenses in fine processing are usually subjected to a fine grinding, lapping and/or polishing process, for which purpose use is made of an appropriate machine. To that extent, in the terminology of the present application the term "polishing", also in word combinations such as, for example, "polishing tool" or the like, shall embrace fine-grinding and lapping processes as well, thus, in the example, fine-grinding or lapping tools.

Manually loaded polishing machines in RX workshops, in particular, are usually constructed as "twin machines" so that advantageously the two spectacle lenses of an "RX job"—a spectacle lens prescription always consists of a spectacle lens pair—can be finely processed simultaneously. Such a "twin" polishing machine is known from, for example, document WO 2012/123120 A1.

According to this prior art (see, in particular, FIGS. 1 to 5 thereof), the polishing machine comprises a machine housing bounding a work chamber into which project two workpiece spindles by way of which two spectacle lenses to be polished can be driven by means of a rotary drive for rotation about workpiece axes C1, C2 of rotation extending substantially parallel to one another. At the tool side the polishing machine has a first linear drive unit by means of which a first tool carriage is movable along a linear axis X extending substantially perpendicularly to the workpiece rotational axes C1, C2, a pivot drive unit which is arranged in the first tool carriage and by means of which a pivot yoke can be pivoted about a pivot setting axis B extending substantially perpendicularly to the workpiece rotational axes C1, C2 and substantially perpendicularly to the linear axis X, a second linear drive unit which is arranged on the pivot yoke and by means of which a second tool carriage is movable along a linear setting axis Z extending substantially perpendicularly to the pivot setting axis B, and two tool spindles each with a respective tool mounting section, wherein the tool mounting sections respectively associated with the workpiece spindles project into the work chamber.

Each tool spindle comprises a spindle shaft on which the respective tool mounting section is formed and which is mounted in a spindle housing to be rotationally driven about an axis A1, A2 of tool rotation, which housing in turn is guided in a guide tube for defined axial displacement in the direction of the tool rotational axis. Whereas the spindle housings of the two tool spindles are flange-mounted on the second tool carriage, the guide tubes are mounted on the pivot yoke so that as a result the tool rotational axis A1 or A2 of each tool spindle forms a plane with the workpiece rotational axis C1 or C2 of the associated workpiece spindle, in which the respective tool rotational axis A1 or A2 is axially displaceable (linear axis X, linear setting axis Z) and tiltable (pivot setting axis B) with respect to the workpiece rotational axis C1 or C2 of the associated workpiece spindle.

By virtue of the movement possibilities given to that extent, the previously known polishing machine allows, in a comparatively compact construction, paired processing of spectacle lenses not only by so-called "tangential polishing kinematics", in which the polishing tools axially adjusted (Z) with the tool spindles are moved in oscillation with relatively small strokes transversely (X) over the spectacle lenses at a preset, but fixed, pivot angle (B) of the tool spindles, but also by polishing kinematics in which the adjusted (Z) polishing tools during the oscillating transverse movement (X) thereof continuously pivot (B) at the same time so as to follow the surface curvature of the spectacle lenses, in which case the spectacle lenses and polishing tools can (at least in the case of the polishing tools, but do not have to) be driven in the same sense or opposite sense at the same rotational speed or different rotational speeds about the axes (A1, A2, C1, C2) of rotation thereof.

In addition, in this prior art the spindle shaft of each tool spindle is constructed as a hollow shaft by way of which the tool mounting section, constructed for mounting a diaphragm chuck tool—such as known from, for example, document EP 2 014 412 A1—can be acted on by a fluid so that with respect to the axial adjustment possibility of the tool quasi a division into two is provided, which, of course, also occasions a certain degree of additional cost. On the one hand, the spindle housing—and thus the tool mounting section provided at the spindle shaft—is entirely guided in the guide tube to be axially displaceable in the direction of the tool rotational axis so that a diaphragm chuck tool held in the tool mounting section can be moved—rather slowly—over relatively large axial travels and positioned with respect to the workpiece to be processed. On the other hand, a polishing disc held at the diaphragm chuck tool is, for example, capable of executing appropriately rapid and finely sensitive axial compensatory movements in correspondence with the respective processing requirements when, for example, workpieces with very pronounced curvatures or more significant changes in curvature over the circumference are processed.

In this connection it is to be emphasized that for, for example, use of the tool spindle in a polishing machine for spectacle lens the axial motion of the polishing tool should be as easy running as possible. This characteristic is important particularly for the polishing of spectacle lenses with toroidal, atoroidal or progressive surfaces with a high degree of departure from rotational symmetry so that the polishing tool always bears on the spectacle lens snugly or areally and with a polishing force (or pressing force) settable with fine sensitivity. If, in particular, the polishing tool during its high-speed rotational movement were to lose contact with the workpiece surface even only briefly, coarser grains and agglomerates present in the polishing medium could lead to scratching of the polished spectacle lens surface.

Based on the prior art according to document WO 2012/123120 A1 it is proposed, from the aspect of machine kinematics, in the earlier International Application PCT/EP2015/001857 (WO 2016/058663 A1) lying closest to the present invention particularly for simplification of tool handling and thus with respect to optimization of processing times to associate with each workpiece spindle of the device two tool spindles at each of which a respective polishing tool is mounted to be rotationally drivable about a tool rotational axis A, A' and axially adjustable (Z) along the tool rotational axis A, A' and which relative to the workpiece spindle are movable in common along a linear axis X extending perpendicularly to the workpiece rotational axis C and pivotable about different pivot setting axes B, B' extending substantially perpendicularly to the workpiece rotational axis C and substantially perpendicularly to the linear axis X, the tool spindles being arranged one behind the other as seen in the direction of the linear axis X.

In that case, each tool spindle has for axial adjustment of the respective polishing tool along the associated tool rotational axis A, A' a piston-cylinder arrangement with a piston which is received in a cylinder housing and which is operatively connected in very compact manner in coaxial arrangement with a central spindle shaft which together with the piston-cylinder arrangement is mounted in a spindle housing to be rotatable about the respective tool rotational axis A, A' and at the end carries a tool mounting head for the polishing tool. In that case, provided for torque transmission from the cylinder housing of the piston-cylinder arrangement to the central spindle shaft is a grooved shaft guide with guide grooves formed in the spindle shaft and a flange nut engaging therewith by way of a linear bearing element and connected with the cylinder housing to be secure against relative rotation.

Although grooved shaft guides of that kind are readily available on the market from, for example, the company Nippon Bearing Co., Ltd., Ojiya-City, Japan, there is here a disadvantage that the axial movability of the tool mounting head is not quite so finely sensitive by comparison with the prior art, as explained in the introduction, according to document WO 2012/123120 A1, in which the torque transmission to the spindle shaft is, as seen from the polishing tool, disposed behind the axial guide (guide element 176) of the diaphragm chuck tool.

OBJECT

The invention has the object of providing a tool spindle, which is constructed as simply and compactly as possible, for a device for fine processing optically effective surfaces of workpieces, the tool mounting section of which during processing of the microgeometry of the workpiece is capable of following the macrogeometry of the workpiece in very easy-running and finely sensitive manner.

ILLUSTRATION OF THE INVENTION

This object is fulfilled by the features indicated in claim 1. Advantageous or expedient developments of the invention are the subject matter of claims 2 to 15.

According to the invention a tool spindle for a device for fine processing of optically effective surfaces of workpieces comprises a spindle housing and tool holding section which projects beyond that and which is axially adjustable (adjustment axis Z) along an axis A of tool rotation by way of a guide arrangement rotationally drivable in the spindle housing about the tool rotational axis A and is optionally tiltable about a tilt point K on the tool rotational axis A, wherein the guide arrangement comprises, for the axial adjustment of the tool holding section, a plurality of linear bearing elements uniformly distributed around the tool rotational axis A and respectively associated guide rods tension-resistantly and compression-resistantly connected with the tool holding section.

Due to the fact that several linear bearing elements with associated guide rods are uniformly distributed around the tool rotational axis A, i.e. have the same radial spacing with respect to the tool rotational axis A and in addition are spaced apart at the same angles as seen around the tool rotational axis A, there is therefore no risk at the outset of imbalances during rotation of the guide arrangement according to the invention about the workpiece rotational axis A, which would be detrimental to easy motion of the axial relative movement. Moreover, torque transmission between the linear bearing elements, which can be closely toleranced, and the guide rods takes place in accordance with the invention in distribution at several points depending on the number of these pairings, so that the individual guide rods can have comparatively small cross-sections, which not least leads to a lesser amount of friction by comparison with the grooved shaft guide provided in the prior art. It has additionally proved that the easy motion and running smoothness of the guide arrangement according to the invention under load, i.e. when loaded by torque, even improves, since as seen in rotational direction there is merely a substantially linear contact between the linear bearing element and the guide rod.

As a result, it is possible for, in particular, axial movements of the tool holding section to take place in highly dynamic manner, which in use of the tool spindle according to the invention in a polishing machine in turn makes possible short processing times with a very high polishing quality, since the polishing tool can always follow the workpiece, even in the case of relatively substantial departures from rotational symmetry at the workpiece. The tool spindle is thus capable of versatile use and allows different processing strategies without this requiring longer processing times.

In a particularly simple embodiment the guide arrangement can comprise a mounting part, which is drivable for rotation about the tool rotational axis A, with recesses for parallel reception of the linear guide elements.

With respect to a particularly stiff configuration of the guide arrangement it is additionally preferred if the guide arrangement comprises a first and a second guide plate, of which the first guide plate is secured on the side of the mounting part remote from the tool holding section to the guide rods extending through the linear bearing elements and rigidly connects these together at a first end, whereas the second guide plate is secured on the side of the mounting part facing the tool holding section to the guide rods and rigidly connects these together at a second end.

With regard to, in particular, smaller moved masses and an advantageous distribution of mass about the tool rotational axis A it is additionally preferred if the guide arrangement comprises exactly three guide rods, which are associated with three linear guide elements arranged on a common circle at a mutual angular spacing of 120° with respect to the tool rotational axis A.

In principle, the linear bearing elements can be any easy-motion bearings providing linear guidance, for example linear slide bearings or linear ball bearings with a ball cage. However, with respect to good serviceability and low costs it is preferred if the linear bearing elements are ball bushes.

As far as the axial adjusting movement of the tool is concerned for preference there is provided a piston-cylinder arrangement for axial adjustment of the tool holding section along the tool rotational axis A, with a piston which is received in a cylinder housing and which is connected, to be effective in terms of actuation, in a serial arrangement with the guide rods of the guide arrangement, the guide arrangement being mounted in the spindle housing to be rotatable together with the piston-cylinder arrangement about the tool rotational axis A. This construction is distinguished particularly by a low weight.

In that case, the cylinder housing of the pneumatically actuable piston-cylinder arrangement is preferably of two-part construction and aligned with a guide sleeve of mineral glass, in which the piston—which consists of graphite material at its guide surface—is received to be longitudinally displaceable. A significant advantage of such a "glass cylinder" results from its very low stick/slip tendency: thus, the tool spindle can operate with fine sensitivity even with very low polishing pressures.

According to an advantageous development the piston of the piston-cylinder arrangement can be tension-resistantly and pressure-resistantly connected with the guide rods of the guide arrangement by way of a thin rod of a spring steel. Such a very light and play-free force transmission element ensures, in simple manner, a possibility for radial compensation, as a result of which jamming cannot occur if the center axes of the piston or the piston-cylinder arrangement and the guide arrangement are not correctly aligned.

For rotary drive of the tool the cylinder housing can be provided at the outer circumference with a helical toothing for engagement with a helically toothed gearwheel which is rotationally drivable by way of a motor so as to rotate the piston-cylinder arrangement and thus the guide arrangement in the spindle housing about the tool rotational axis A. Such a rotary drive by means of standard drive elements is not only very smooth-running and economic, but has, by comparison with an equally conceivable rotary drive arranged coaxially with respect to the guide arrangement, the advantage of lower moved masses, which in turn promotes high quality of the polished surfaces with short processing times.

Moreover, the guide arrangement of the tool spindle can comprise a ball joint for tilting the tool holding section relative to the tool rotational axis A. This makes possible, in simple manner, tilting of the tool relative to the tool rotational axis A of the tool spindle during, for example, processing by polishing, so that the tool can also easily follow in terms of angle the different workpiece geometries, even, for example, cylindrical surfaces or progressive surfaces with high additions at, for example, spectacle lenses. Moreover, the tilt capability of the tool advantageously allows execution of polishing processes with the already discussed "tangential polishing kinematics", in which case the tool is capable of orientation at the workpiece in terms of angle.

In that regard, the ball joint having a ball head received in a ball socket can be constructed in such a way that the ball head is formed at a ball pin securable to the guide rods of the guide arrangement, whereas the ball socket is formed in the tool holding section. A converse arrangement of the ball joint, with ball socket on the side of the guide rods and ball pin on the side of the tool holding section, is, of course, equally conceivable.

In a special embodiment the ball head can have a receiving bore for a transverse pin which extends through the ball head and on both sides of the ball head engages by associated cut-outs in the ball socket so as to connect the tool holding section with the ball pin by mechanically positive couple to be capable of rotational entrainment. An embodiment of the ball head of that kind as a cardan joint makes it possible in simple manner to rotationally drive the tool, which by comparison with an equally conceivable purely frictionally produced rotational entrainment of the tool by the workpiece enables substantially shorter processing times. With respect to tiltability and rotational drive possibility something similar, but with improved easy motion at large tilt angles, could be realized by means of a ball joint constructed as a ball hexagon joint with the ball pin similar to a ball Allen key on one side and a hexagon socket screw, for example in accordance with DIN 912, on the other side.

In a further embodiment of the tool spindle it can be provided that the tool holding section is resiliently supported by way of a resilient annular element on a support flange at the ball pin side in such a way that the tool holding section seeks to achieve alignment by its center axis with the ball pin and thus the tool rotational axis A of the tool spindle. The tool is merely prevented from excessive tilt movements, which on the one hand has a favorable result particularly during movement reversal in the case of the mentioned oscillation of the tool over the workpiece, since the tool cannot buckle and consequently jam at the workpiece. On the other hand, such resilient support of the tool holding section is of advantage during mounting or placing of the tool, because the tool holding section adopts a defined position with light constraint. The movement together of tool and workpiece can in addition take place as a consequence of the resilient (pre-) orientation of the tool holding section in such a way that the tool is placed on the workpiece substantially in axial orientation and not, perhaps, tilted, which could lead to problems, for example in the case of particularly thick or high polishing discs. In principle, it would, in fact, also be possible to manage such (pre-) orientation of a polishing disc by means of a pneumatically loadable rubber bellows at the tool holding section, but this would be disproportionately more expensive.

In further pursuit of the concept of the invention the ball joint of the guide arrangement can, in an alternative conceived particularly for precision optical applications, be constructed without a transverse pin and to be unbiased, i.e. without the afore-described resilient (pre-) orientation of the tool holding section. In that case, rotational entrainment of the tool holding section by the guide arrangement takes place merely on the basis of friction in the joint gap between ball head and ball socket of the ball joint. A polishing process can thus be performed less aggressively. At the same time, the tool holding section even in the case of large tilt angles with respect to the tool rotational axis A can readily follow the geometry of the processed workpiece, particularly because the cardan errors associated with the transverse pin solution are avoided.

Finally, a polishing disc can be exchangeably mounted on the tool holding section, for which purpose a base body of the polishing disc and the tool holding section are provided with complementary structures for axial detenting and for rotational entrainment of the polishing disc by the tool holding section. This produces on the one hand an uncomplicated exchangeability of the polishing disc as well as secure retention of the polishing disc on the tool spindle and on the other hand a defined mechanically positive transmission of torque between tool holding section and polishing disc during the polishing.

BRIEF DESCRIPTION OF THE DRAWINGS

The invention is explained in more detail in the following by way of preferred embodiments with reference to the accompanying partly simplified or schematic drawings which are not true to scale, wherein the same or corresponding parts are provided with the same reference numerals and in a given case supplemented by a superscript dash (') so as to indicate that a variant is concerned. In the drawings.

DETAILED DESCRIPTION OF THE EMBODIMENT

Figure 1:
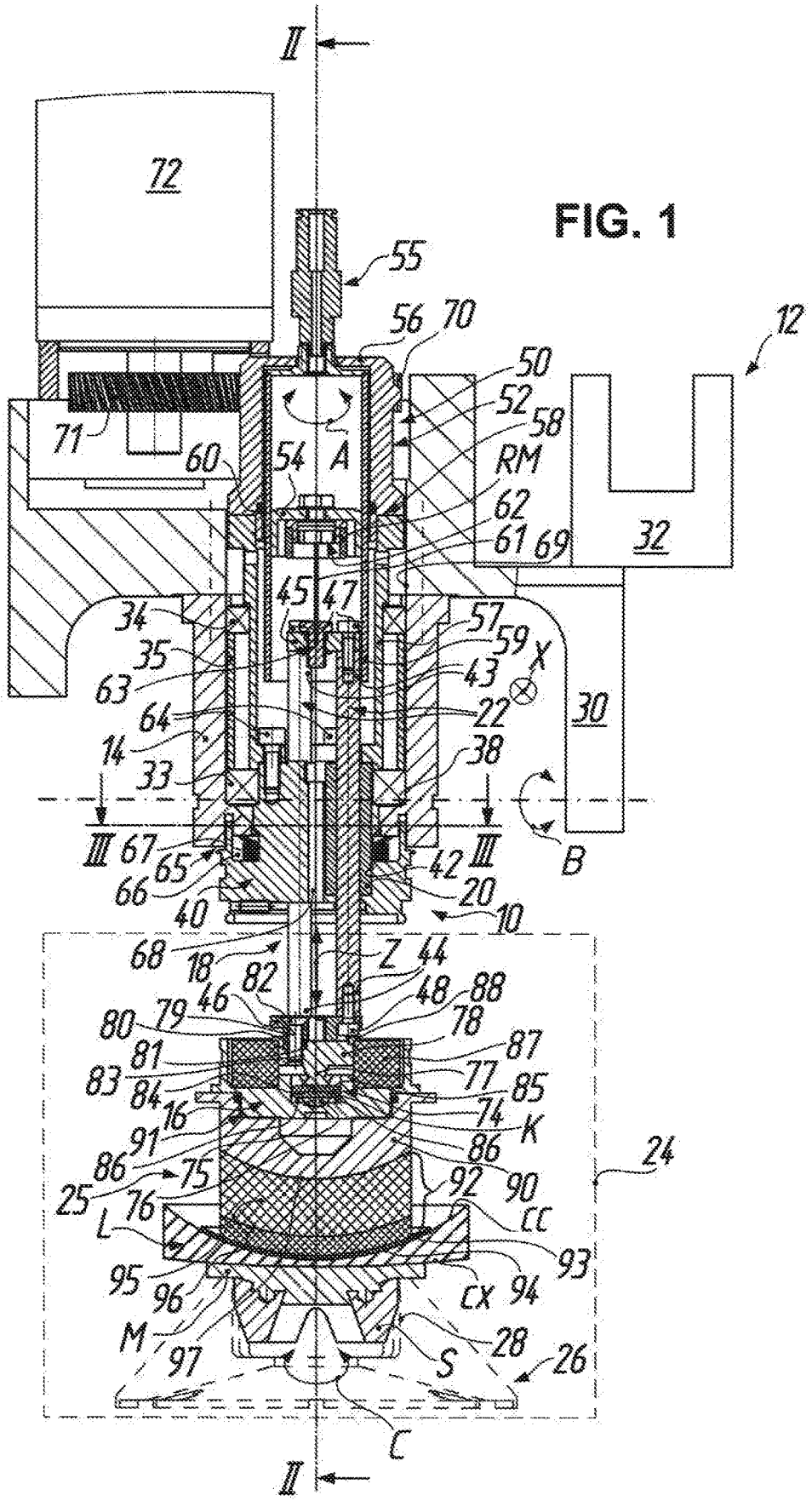
FIG. 1 shows a longitudinal sectional view of a tool spindle for a device for fine processing of optically effective surfaces of workpieces in accordance with a first embodiment of the invention, which spindle is received in a pivot yoke—illustrated partly broken away—of the device and detachably holds a polishing disc at a tool holding section rotatable about a tool rotational axis A, the disc being disposed in processing engagement with a surface of the workpiece to be processed, wherein the polishing disc is disposed in a lower setting moved out (adjustment axis Z) relative to the tool spindle and for simplification of the illustration an associated bellows at the tool holding section has been omitted.

As a possible application or place of use of a tool spindle 10 according to the invention a device for the fine processing of optically effective surfaces cc, cx of workpieces such as, for example, spectacle lenses L is denoted generally by 12 in FIG. 1. The device 12, which is illustrated only partly in FIG. 1, forms a subassembly of a polishing machine explained in more detail in earlier International Application PCT/EP2015/001857 (WO 2016/058663 A1). The device 12 and the polishing machine shall be described in the following only to the extent appearing necessary for an understanding of the present invention. Otherwise, at this point in order to avoid repetition express reference may be made to the earlier International Application PCT/EP2015/001857 (WO 2016/058663 A1) with respect to the construction and function of the device 12 and polishing machine.

The tool spindle 10 comprises a spindle housing 14 and a tool holding section 16, which projects beyond that and which is axially adjustable (adjustment axis Z) along the tool axis A of rotation by way of a guide arrangement 18—which is drivable in the spindle housing 14 for rotation about the tool rotational axis A—and at least in the embodiment illustrated here is tiltable about a tilt point K on the tool rotational axis A. A significant aspect is that the guide arrangement 18, to be described in more detail in the following, has for axial adjustment of the tool holding section 16 a plurality of linear bearing elements 20, which are uniformly distributed around the tool rotational axis A, and respectively associated guide rods 22, which are tension-resistantly and compression-resistantly connected with the tool holding section 16.

As shown in FIG. 1, the tool spindle 10 projects into a work chamber 24—indicated in FIG. 1 by dashed lines—of the polishing machine and at the end carries therein at its tool holding section 16 a polishing tool 25 which consequently is drivable for rotation about the tool rotational axis A and axially adjustable (adjustment axis Z) along the tool rotational axis A. The device 12 further comprises a workpiece spindle 26 which is associated with the tool spindle 10 and projects oppositely into the work chamber 24 and by way of which a spectacle lens L to be polished can be driven to rotate about a workpiece rotational axis C at a predetermined rotational speed and in a predetermined direction of rotation, the spectacle lens usually being held by means of a blocking material M on a block piece S for mounting in a clamping chuck 28 of the workpiece spindle 26.

The tool spindle 10 is movable under CNC position control relative to the workpiece spindle 26 along a linear axis X, which extends substantially perpendicularly to the workpiece rotational axis C, by means of a driven tool carriage (not shown) and pivotable about a pivot adjusting axis B extending substantially perpendicularly to the workpiece rotational axis C and substantially perpendicularly to the linear axis X. In that case the tool spindle 10 is mounted on or in a pivot yoke 30, which is pivoted to the tool carriage in a manner not illustrated here and which is pivotable in defined manner about the pivot adjusting axis B by means of a linear drive (not shown) engaging a fork-shaped pivot arm 32 of the pivot yoke 30.

More precisely, the tool spindle 10 is flange-mounted from below on the pivot yoke 30 by way of the spindle housing 14 according to FIG. 1. The dot-dashed lines shown thereat in FIG. 1 indicate a screw connection. The further components or subassemblies of the tool spindle 10 are rotatably mounted in the spindle housing 14 by way of a bearing arrangement of roller bearings comprising a lower fixed bearing 33 and an upper floating bearing 34, which are mounted in the spindle housing 14 at a spacing from one another by means of a spacer bush 35. In that case, the floating bearing 34 is drawn against the spacer bush 35, as shown in FIG. 2, by way of a plurality of round-head screws 37 uniformly distributed at the circumference and screwed at the end into threaded bores 36 of the spindle housing 14, whereas the fixed bearing 33 is supported at an annular shoulder 38 formed in the spindle housing 14 at the bottom in FIGS. 1 and 2.

Figure 2:
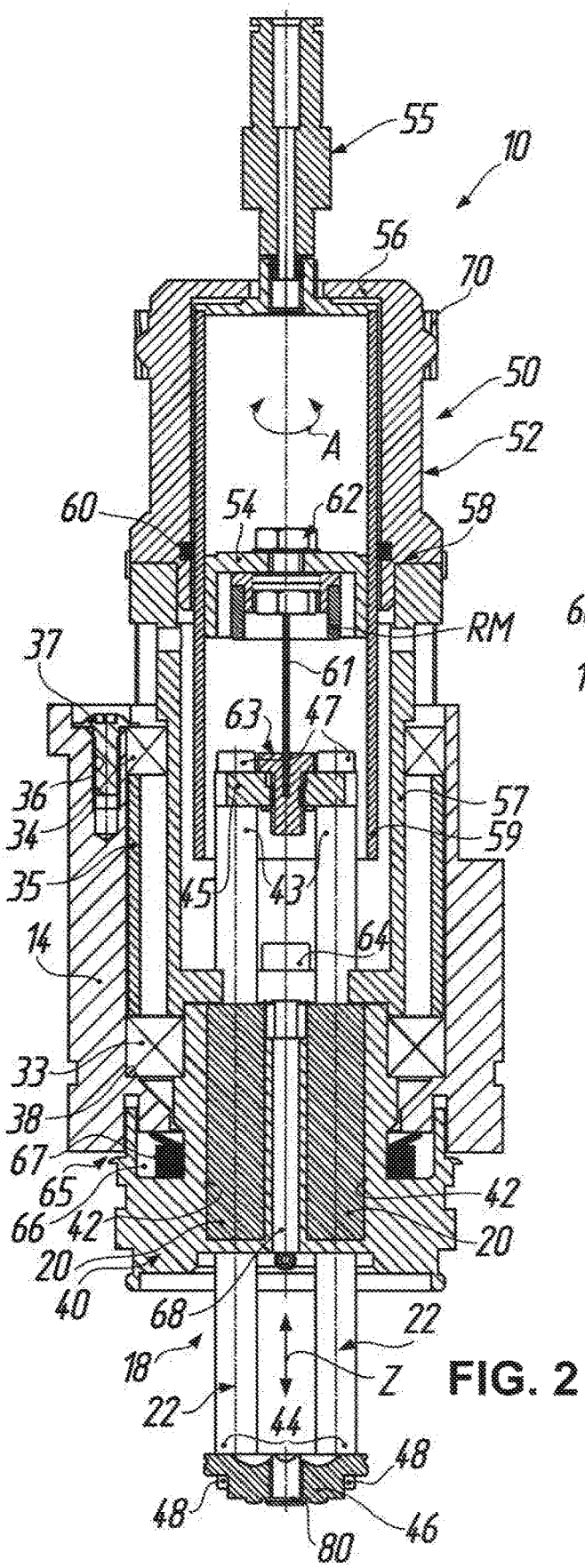
FIG. 2 shows a sectional view of the tool spindle of FIG. 1 in correspondence with the section line II-II in FIG. 1, wherein a ball joint of a guide arrangement of the tool spindle has been omitted, which ball joint mounts the tool holding section on the tool spindle to be tiltable with respect to the tool rotational axis A.
Figure 3:
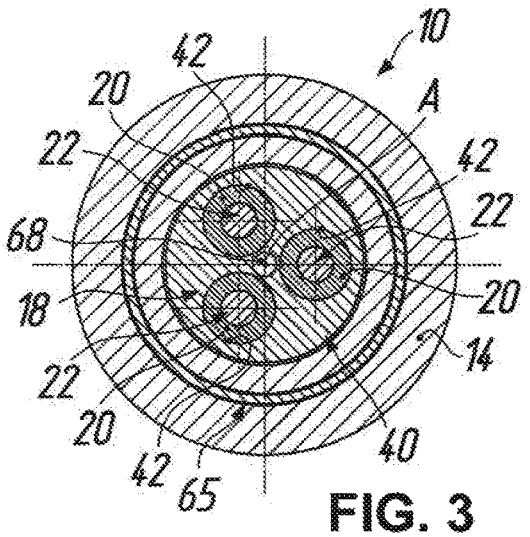
FIG. 3 shows a sectional view of the tool spindle of FIG. 1, in correspondence with the section line III-III in FIG. 1, for further illustration of linear bearing elements, which are uniformly distributed around the tool rotational axis A, and respectively associated guide rods which are tension-resistantly and pressure-resistantly connected with the tool holding section and which comprise the guide arrangement of the tool spindle for axial adjustment (adjustment axis Z) of the tool holding section.

According to FIGS. 1 to 3, the guide arrangement 18 comprises a mounting part 40 which is drivable for rotation about the tool rotational axis A and which for that purpose is mounted in the spindle housing 14 byway of the fixed bearing 33. The mounting part 40 is provided with recesses 42 for axially parallel reception of the linear bearing elements 20. As FIG. 3 further shows, the guide arrangement 18 in the illustrated embodiment comprises exactly three guide rods 22 of a metallic solid material, with which in total three linear bearing elements 20 are associated, these being arranged on a common circle in the recesses 42 at a mutual angular spacing of 120° with respect to the tool rotational axis A so that the linear bearing elements 20 all have the same radial spacing from the tool rotational axis A. The linear bearing elements 20 are here ball bushes such as are commercially available from, for example, the company Nippon Bearing Co., Ltd., Ojiya-City, Japan, under the designation "SM-W Type—Double Wide Type".

Figure 4:
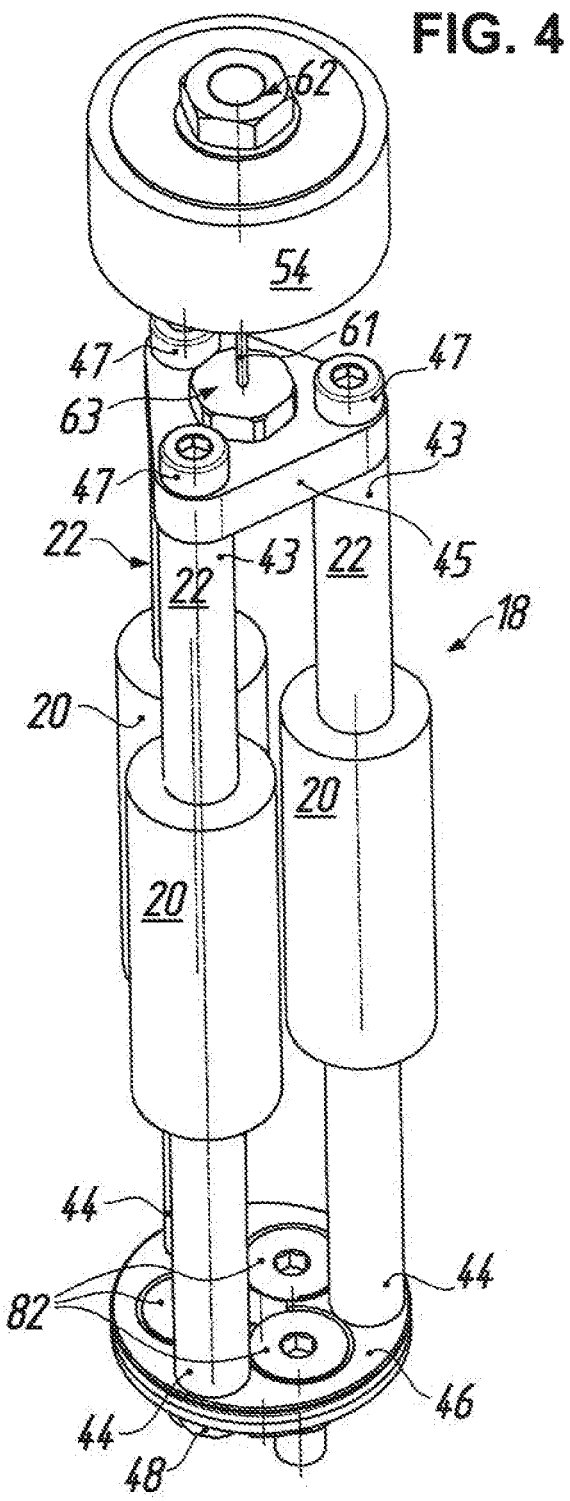
FIG. 4 shows a perspective view of the linear bearing elements and guide rods, which are separated by the tool spindle, of the guide arrangement of the tool spindle according to FIG. 1 obliquely from above, which illustrates how the guide rods are rigidly connected together by way of upper and lower guide plates and the guide arrangement is coupled with a piston of a piston-cylinder arrangement for axial adjustment (adjustment axis Z)
Figure 5:
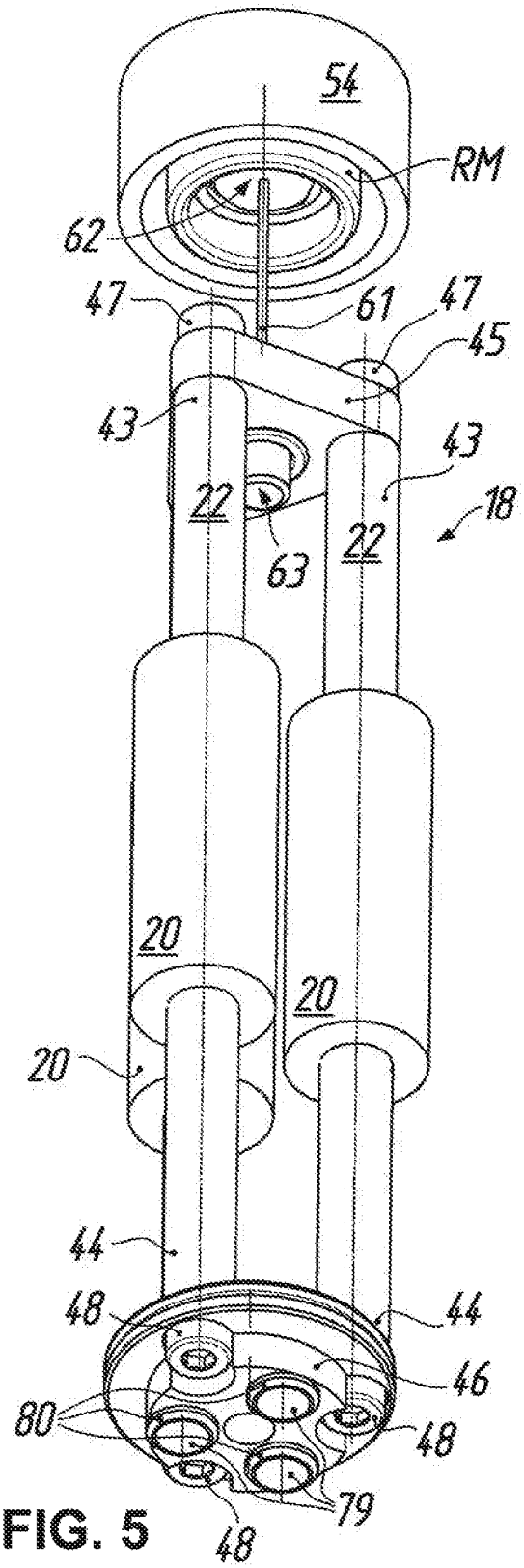
FIG. 5 shows a perspective view of the subassembly of FIG. 4 obliquely from below.

As can be best seen in FIGS. 4 and 5, the guide arrangement 18 further comprises a first guide plate 45 and a second guide plate 46 at the first ends 43 and second ends 44 of the cylindrical guide rods 22. The first guide plate 45, which is substantially triangular as seen in plan view, is secured on the side of the mounting part 40 remote from the tool holding section 16 to the guide rods 20, which extend through the linear bearing elements 20, at the end by means of screws 47 so that it rigidly connects the guide rods 22 together at the first ends 43 thereof. On the other hand, the second guide plate 46, which is circularly round as seen in plan view, is secured on the side of the mounting part 40 facing the tool holding section 16 to the guide rods 22 at the end by means of screws 48 and rigidly connects these together at the second ends 44 thereof.

In addition, for axial adjustment (adjustment axis Z) of the tool holding section 16 along the tool rotational axis A the tool spindle 10 comprises a piston-cylinder arrangement 50. The piston-cylinder arrangement 50 has a piston 54 which is received in a cylinder housing 52 and which is connected, to be effective in terms of actuation, in a serial arrangement with the guide rods 22 of the guide arrangement 18. In order to move out the tool holding section 16 relative to the spindle housing 14 the piston-cylinder arrangement 50 can be pneumatically acted on by way of a proprietary rotary feedthrough 55 at the end of the cylinder housing 52 upper in FIGS. 1 and 2. In that case, the piston-cylinder arrangement 50 together with the guide arrangement 18 is mounted in the spindle housing 14 to be rotatable about the tool rotational axis A, as already indicated.

According to FIGS. 1 and 2 the cylinder housing 52 is, in addition, of two-part construction, with a housing upper part 56 and a housing lower part 57 which are centered relative to one another at 58 and connected, for example screw-connected, together. In that case, received in the interior for lining the cylinder housing 52 is a guide sleeve 59 of mineral glass which is secured to the housing upper part 56 by means of a threaded nut (not shown) provided below the rotary feedthrough 55 as well as centered in the housing upper part 56 with the assistance of an O-ring 60 and in which the piston 54, which consists of a graphite material at its guide surface, is received to be longitudinally displaceable. "Glass cylinders" of that kind with very easy motion and substantially free of stick-slip are commercially available from, for example, the company Airpot Corporation, Norwalk, Conn., United States. In order to avoid jamming, which can result from axial alignment errors of the (ideally) coaxially arranged components, the piston 54 of the piston-cylinder arrangement 50 is tension-resistantly and compression-resistantly connected with the first guide plate 45 of the guide arrangement 18 by way of a thin rod 61 of a spring steel and, in particular, by way of the central screw connections 62 and 63, which are shown at the top and bottom at the rod 61 in FIGS. 1, 2, 4 and 5, to the piston 54 and the first guide plate 45, respectively.

The housing lower part 57 of the cylinder housing 52 is rotatably supported at the top in FIGS. 1 and 2 in radial direction at the spindle housing 14 by way of the floating bearing 34. The mounting part 40 is flange-mounted on the housing lower part 57 at the bottom in FIGS. 1 and 2 by means of a screw connection 64, which in that case axially clamps the inner ring of the fixed bearing 33 together with the housing lower part 57. The mounting part 40 in that regard also forms with the underside of the spindle housing 14, at 65, a sealing labyrinth with narrow gap dimensions and additionally has radially within the sealing labyrinth 65 an annular recess 66 for reception of a sealing ring 67, the sealing lip of which similarly co-operates in sealing manner with the underside of the spindle housing 14. Finally, the mounting part 40 has a central passage 68 which connects a region above the mounting part 40 with a region below the mounting part 40 so that in the case of axial displacement of the guide arrangement 18, more precisely the guide rods 22 and guide plates 45, 46 thereof, with respect to the spindle housing 14 no additional air spring effect obstructing the movement can arise.

As FIG. 1 shows, the cylinder housing 52 of the piston-cylinder arrangement 50 extends through an opening 69 formed in the pivot yoke 30 and projects beyond this—upwardly in FIG. 1—by its housing upper part 56. The housing upper part 56 of the cylinder housing 52 is there provided at the outer circumference with a helical toothing 70 for engagement with a very smooth-running gearwheel 71 which is helically toothed below, for example, 20° and which is of the same diameter. The gearwheel 71 is drivable by way of a motor 72, which is flange-mounted from above on the pivot yoke 30, so as to rotate the piston-cylinder arrangement 50 and thus the guide arrangement 18 in the spindle housing 14 controllably in rotational speed and rotational direction about the tool rotational axis A. In that case, torque transmission takes place from the thus rotationally drivable cylinder housing 52 of the piston-cylinder arrangement 50 by way of the screw connection 64 to the mounting part 40 and from there by way of the linear bearing elements 20 to the guide rods 22 of the guide arrangement 18, which in turn entrain the second guide plate 46.

In that regard it is to be noted that the lower guide plate 46 of the tool spindle 10 is rotationally drivable, controllably in rotational speed and rotational direction, about the tool rotational axis A and/or is adjustable along the tool rotational axis A (adjustment axis Z) optionally also with very fine sensitivity. In order to recognize the moved-up position of the guide plate 46/polishing tool 25 and thus a tool loading position of the tool spindle 10 an annular magnet RM is glued in place in the piston 54 of the piston-cylinder arrangement 50 and co-operates with a magnet sensor (not shown) in the vicinity of the rotary feedthrough 55.

In addition, the guide arrangement 18 comprises, for tilting the tool holding section 16 with respect to the tool rotational axis A, a ball joint 74 defining the tilt point K for the tool holding section 16 on the tool rotational axis A. According to FIG. 1, the ball joint 74 has a ball head 76 which is received in a ball socket 75 and at which a ball pin 77 securable to the guide rods 22 of the guide arrangement 18 is formed, whereas the ball socket 75 is formed in the tool holding section 16. In order to secure the ball pin 77 to the guide rods 22 the ball pin 77 is connected, for example by integral construction, with a flange section 78 which is axially and rotationally firmly screw-connected with the lower guide plate 46. As can be best seen in FIGS. 4 and 5, the guide plate 46 is for that purpose provided within the circle, which is formed by the screws 48, with three passage bores 79 which are angularly spaced by 120° with respect to the tool rotational axis A and which in the flange section 78 end at the underside of the guide plate 46, in a region of a guide plate 46 protruding beyond the screws 48, by annular collars 80 for mechanically positive reception in associated annular recesses 81 (see FIG. 1). The passage bores 79 are penetrated from above between the ends 44 of the guide rods 22 by securing screws 82 screwed into associated threaded bores 83, which connect with the annular recesses 81, in the flange section 78 so as to draw the flange section 78 firmly against the guide plate 46 and thus mechanically positively and frictionally fix it to the guide plate 46.

In the embodiment illustrated in FIG. 1 the ball head 46 has a receiving bore 84 for a transverse pin 85 which extends through the ball head 76 by rounded ends and engages on either side of the ball head 76 in associated cut-outs 86 or slots, which are arranged diametrally with respect to the tilt point K, in the ball socket 75 so as to connect the tool holding section 16 in the manner of a cardan joint with the ball pin 77 and thus with the guide rods 22 of the tool spindle 10 to be capable of rotational entrainment. In that case, the tool holding section 16 is resiliently supported by way of a resilient annular element 87 of, for example, a suitable foam material on a support flange 88, which is at the ball pin side, at the flange section 78 in such a manner that the tool holding section 16 seeks to align by the center axis thereof with the ball pin 77 and thus the tool rotational axis A of the tool spindle 10.

In the illustrated embodiment a polishing disc as polishing tool 25 is mounted on the tool holding section 16 to be capable of axial and rotational entrainment, but at the same time detachably, i.e. exchangeably. For that purpose a base body 90 of the polishing disc 25 and the tool holding section 16 are provided with complementary structures 91 for axial detenting and rotational entrainment of the polishing disc 25 with and by the tool holding section 16. This interface, which is formed by the complementary structures 91, between the polishing disc 25 and tool holding section 16 is the subject of document EP 2 464 493 B1, to which at this point for the avoidance of repetition express reference is made with regard to construction and function of the interface.

An intermediate layer 92, which is softer by comparison with the base body 90, of a resilient material is secured to the base body 90 of the polishing disc 25 illustrated here, wherein a polishing medium carrier 93 forming the actual, outer processing surface 94 of the polishing disc 25 rests on the intermediate layer. This form of the polishing disc 25 is special insofar as the intermediate layer 92 has at least two regions of different hardness, these being arranged one behind the other in the direction of the center axis of the polishing disc 25, wherein the region of the intermediate layer 92 adjoining the base body 90 is softer than the region of the intermediate layer 92 on which the polishing medium carrier 93 rests. More precisely, the two regions of the intermediate layer 92 are here formed by mutually different foam material layers 95 and 96 of respective constant thickness as seen along the center axis of the polishing disc 25, namely a softer foam material layer 95 on the base body 90, more precisely the spherical end surface 97 thereof, and a harder foam material layer 96 under the polishing medium carrier 93. In that case, the individual components (90, 95, 96, 93) of the polishing disc 25 are glued together. This polishing disc 25, which is universally usable for a large range of workpiece curvatures, is the subject—particularly the actual form and dimensioning—of earlier International Patent Application PCT/EP2015/001849, to which at this point express reference is made for avoidance of repetition.

The various polishing processes, which are performable with the afore-described kinematics of the device 12 by means of the tool spindle 19 and in which in addition a liquid polishing medium is supplied by way of polishing medium nozzles (not shown)—which are provided at the workpiece spindle 26—to the place of action between tool and workpiece, are well-known to the expert and therefore will not be described in more detail at this point (for this purpose see also the polishing kinematics, already described above in the introductory description with regard to the prior art, especially with "tangential" and/or "pivoting" relative movement between tool and workpiece).

Other polishing tools or polishing discs appropriate to the respective polishing requirements can obviously also be used with the tool spindle 10. Thus, it would be possible, for example, to use tools according to document U.S. Pat. No. 7,559,829 B2 without a rigid rotary drive. In this case, the receiving bore and transverse pin would be redundant in the ball head of a somewhat longer ball pin as would the support flange and the resilient annular element of the polishing tool illustrated in FIG. 1. Use would be made instead of a similar, but somewhat larger in diameter, flange with an outer radial groove for receiving a bellows. In this case of use it would be ensured through the possible rotary drive of the ball head that high relative speeds in the joint gap between ball head and ball socket of the ball joint would not arise, which could otherwise cause substantial wear due to the strongly abrasive action of the polishing medium.

Figure 6:
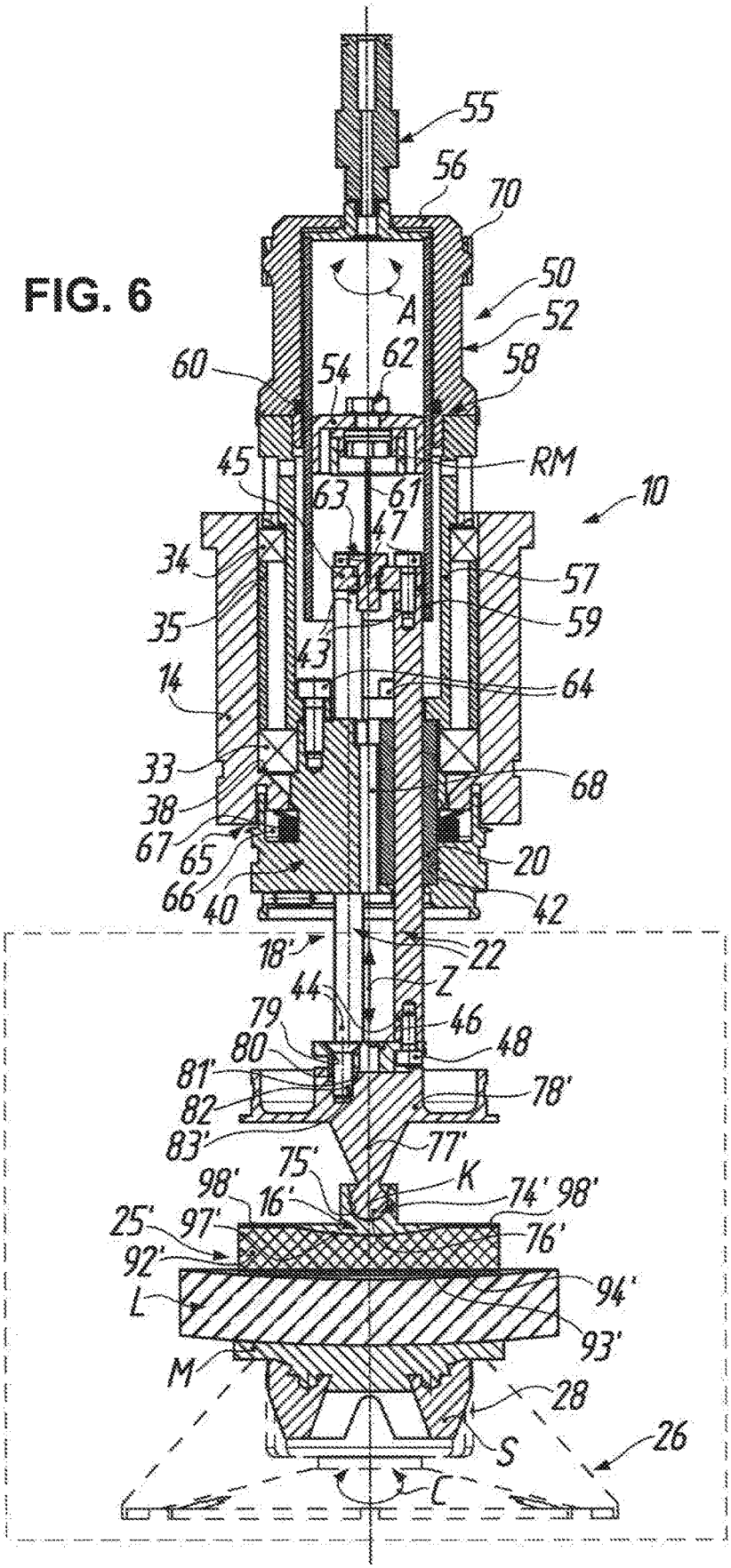
FIG. 6 shows a longitudinal sectional view, which corresponds with respect to the section line of FIG. 1, of a tool spindle for a device for fine processing of optically effective surfaces of workpieces in accordance with a second embodiment of the invention, in which, in particular, the ball joint of the guide arrangement of the tool spindle is of different construction and the tool holding section is a component of a different polishing tool, which is disposed in processing engagement with a surface of the workpiece to be processed, in the setting and with the simplifications of FIG. 1.

FIG. 6 shows a further variant of the tool spindle 10 such as can be used, for example, for precision-optical polishing procedures and which in the following will be explained only to the extent that it differs from the tool spindle 10 described above with reference to FIGS. 1 to 5. Differences here consist merely in the design of the ball joint 74' of the guide arrangement 18' and of the polishing tool 25'.

According to FIG. 6, the ball joint 74' of the guide arrangement 18' is constructed, in particular, without a transverse pin and to be unbiased so that the tool holding section 16' can tilt not only free of play, but also with an easy motion with respect to the tool rotational axis A. Accordingly, in the case of the ball joint 74' of FIG. 6 and by comparison with the embodiment of the transverse pin according to FIG. 1 the receiving bore for that purpose in the ball head 76' as well as the associated cut-outs in the ball socket 75' of the tool holding section 16' are absent. Also lacking is a bias at the ball joint 74', i.e. by comparison with the flange section 78' screw-connected with the second guide plate 46 of the guide arrangement 18' at 82, the tool holding section 16' as a consequence of omission of the annular element of FIG. 1 is not resiliently supported. Accordingly, transmission of the rotational movement of the tool spindle 10 from the second guide plate 46 to the polishing tool 25' can take place merely by friction in the joint gap between the ball head 76' and the ball socket 75' at the tool holding section 16'.

In the embodiment of FIG. 6 the polishing tool 25' itself has—by contrast with the individual shape-linked polishing tools otherwise used in precision optical production—spring arms indicated at 98' which are connected in radial direction with the tool holding section 16' and which axially resiliently support a resilient layer 92' of, for example, a unitary foam material, to which the polishing medium carrier 93' forming the actual processing surface 94' of the polishing tool 25' is attached. By contrast, the intermediate layer 92' is supported in a center region of the polishing tool 25' on the fixed spherical end surface 97' of the tool holding section 16'.

Since in the embodiment of FIG. 6 by comparison with the construction according to FIG. 1 the spacing between the tilt point K of the guide arrangement 18' and the processing surface 94' of the polishing tool 25' is significantly smaller the risk is excluded, notwithstanding omission of the annular element resiliently supporting the tool holding section 16', that the polishing tool 25' unintentionally tilts away and as a consequence damage or excessive deformation of tool and workpiece occurs, so that there is always a high level of processing reliability.

In the case of this variant, moreover, a hydraulic expansion chuck could be provided for holding components, which are cemented on precision cement members in accordance with DIN 58767, instead of the indicated clamping chuck 28 (collet chuck).

A tool spindle for a device for fine processing of optically effective surfaces at workpieces has a spindle housing and a tool holding section projecting beyond that. The tool holding section can be axially adjusted (adjustment axis Z) along the tool rotational axis with respect to the workpiece by way of a guide arrangement, which is drivable in the spindle housing for rotation about a tool rotational axis A, and can be optionally tilted about a tilt point K on the tool rotational axis. In that case, the guide arrangement for the axial adjustment of the tool holding section comprises a plurality of linear bearing elements, which are uniformly distributed about the tool rotational axis, and respectively associated guide rods, which are tension-resistantly and compression-resistantly connected with the tool holding section. As a result, the tool holding section during processing of the microgeometry of the workpiece is able to follow the macrogeometry of the workpiece with a very easy motion and fine sensitivity.

The invention claimed is:

1. A tool spindle for a device for fine processing of optically effective surfaces of workpieces, comprising a spindle housing and a tool holding section projecting beyond the spindle housing, that is rotatably arranged with respect to the spindle housing about an axis of rotation of the tool and axially adjustable along the axis of rotation of the tool by way of a guide arrangement, wherein the guide arrangement for the axial adjustment of the tool holding section comprises a plurality of linear bearing elements uniformly distributed around the axis (A) of rotation of the tool, respectively associated guide rods and a mounting part with recesses for parallel reception of the linear bearing elements, said mounting part being rotatably mounted in the spindle housing by way of a bearing arrangement, and wherein the guide rods of the guide arrangement are connected with the tool holding section to be capable of transmitting at least tensile and compressive forces between the guide rods and the tool holding section and also being mounted for rotation about the axis of rotation of the tool.

2. A tool spindle according claim 1, wherein the tool holding section is tiltable about a tilting point on the axis of rotation of the tool, and wherein the guide arrangement comprises a ball joint for tilting of the tool holding section with respect to the axis of rotation of the tool.

3. A tool spindle according to claim 2, wherein the ball joint comprises a ball head which is received in a ball socket and which is formed at a ball pin securable to the guide rods of the guide arrangement, whereas the ball socket is formed in the tool holding section.

4. A tool spindle according to claim 3, wherein the ball head has a receiving bore for a transverse pin which extends through the ball head and engages on either side of the ball head in associated cut-outs in the ball socket so as to connect the tool holding section with the ball pin to be capable of rotational entrainment.

5. A tool spindle according to claim 3, wherein the tool holding section is so resiliently supported on a support flange at the ball pin side by way of a resilient annular element that the tool holding section seeks to align by its center axis with the ball pin and thus the axis of rotation of the tool of the tool spindle.

6. A tool spindle according to claim 1, wherein a polishing disc is exchangeable mounted on the tool holding section, for which purpose a base body of the polishing disc and the tool holding section are provided with complementary structures for axial detenting with and entrainment of the polishing disc by the tool holding section.

7. A tool spindle for a device for fine processing of optically effective surfaces of workpieces, comprising a spindle housing and a tool holding section projecting beyond the spindle housing, that is rotatably arranged with respect to the spindle housing about an axis of rotation of the tool and axially adjustable along the axis of rotation of the tool by way of a guide arrangement, wherein the guide arrangement for the axial adjustment of the tool holding section comprises a plurality of linear bearing elements uniformly distributed around the axis (A) of rotation of the tool, respectively associated guide rods and a mounting part with recesses for parallel reception of the linear bearing elements, said mounting part being rotatably mounted in the spindle housing by way of a bearing arrangement, and wherein the guide rods of the guide arrangement are connected with the tool holding section to be capable of transmitting at least tensile and compressive forces between the guide rods and the tool holding section wherein the guide arrangement comprises a first guide plate and a second guide plate, of which the first guide plate is secured on the side of the mounting part remote from the tool holding section to the guide rods extending through the linear bearing elements and rigidly connects the guide rods together at a first end, whereas the second guide plate is secured on the side of the mounting part facing the tool holding section to the guide rods and rigidly connects the guide rods together at a second end.

8. A tool spindle according to claim 7, wherein the guide arrangement comprises exactly three guide rods , with which three linear bearing elements are associated, the linear bearing elements being arranged on a common circle at a mutual angular spacing of 120° with respect to the axis of rotation of the tool.

9. A tool spindle according to claim 8, wherein the linear bearing elements are ball bushes.

10. A tool spindle according to claim 9, wherein provided for the axial adjustment of the tool holding section along the axis of rotation of the tool is a piston-cylinder arrangement with a piston which is received in a cylinder housing and which is connected in serial arrangement with the guide rods of the guide arrangement for actuation thereof, the guide arrangement being mounted in the spindle housing together with the piston-cylinder arrangement to be rotatable about the axis of rotation of the tool.

11. A tool spindle according to claim 10, wherein the cylinder housing of the pneumatically actuable piston-cylinder arrangement is of two-part construction and is lined by a guide sleeve of mineral glass in which the piston , which at its guide surface is made from a graphite material, is received to be longitudinally displaceable.

12. A tool spindle according to claim 11, wherein the piston of the piston-cylinder arrangement is tension-resistantly and compression-resistantly connected with the guide rods of the guide arrangement by way of a thin rod of a spring steel.

13. A tool spindle according to claim 12, wherein the cylinder housing is provided at the outer circumference with a helical toothing for engagement with a helically toothed gearwheel which is rotationally drivable by way of a motor in order to rotate the piston-cylinder arrangement and thus the guide arrangement in the spindle housing about the axis of rotation of the tool.

14. A tool spindle according claim 13, wherein the tool holding section is tiltable about a tilting point on the axis of rotation of the tool, wherein the guide arrangement and comprises a ball j oint for tilting of the tool holding section with respect to the axis of rotation of the tool.

15. A tool spindle according to claim 14, wherein the ball joint comprises a ball head which is received in a ball socket and which is formed at a ball pin securable to the guide rods of the guide arrangement, whereas the ball socket is formed in the tool holding section.

16. A tool spindle according to claim 15, wherein the ball head has a receiving bore for a transverse pin which extends through the ball head and engages on either side of the ball head in associated cut-outs in the ball socket so as to connect the tool holding section with the ball pin to be capable of rotational entrainment.

17. A tool spindle according to claim 16, wherein the tool holding section is so resiliently supported on a support flange at the ball pin side by way of a resilient annular element that the tool holding section seeks to align by its center axis with the ball pin and thus the axis of rotation of the tool of the tool spindle.

18. A tool spindle according to claim 15, wherein the ball joint of the guide arrangement is free of a transverse pin and unbiased.

19. A tool spindle according to claim 18, wherein a polishing disc is exchangeably mounted on the tool holding section , for which purpose a base body of the polishing disc and the tool holding section are provided with complementary structures for axial detenting with and entrainment of the polishing disc by the tool holding section.

* * * * *